United States Patent [19]

Newham et al.

[11] Patent Number: 4,785,266

[45] Date of Patent: Nov. 15, 1988

[54] DIELECTRIC ROD POLARIZER HAVING WEDGE SHAPE POLARIZING PORTIONS

[75] Inventors: Paul Newham, Middlesex; Bernard J. Andrews, Hertfordshire, both of England

[73] Assignee: The Marconi Company Limited, England

[21] Appl. No.: 70,063

[22] Filed: Jul. 6, 1987

Related U.S. Application Data

[63] Continuation of Ser. No. 766,102, Aug. 15, 1985, abandoned.

[30] Foreign Application Priority Data

Aug. 20, 1984 [GB] United Kingdom ..... 8421102

[51] Int. Cl.[4] ..... H01P 1/17

[52] U.S. Cl. ..... 333/21 A; 333/157; 333/34

[58] Field of Search ..... 333/21 A, 21 R, 157, 333/34; 343/756, 909

[56] References Cited

U.S. PATENT DOCUMENTS

| | | | |
|---|---|---|---|
| 2,599,753 | 6/1952 | Fox | 333/157 X |
| 3,216,017 | 11/1965 | Moore | 343/756 |
| 3,518,691 | 6/1970 | Hallendorff | 333/34 X |
| 4,195,270 | 3/1980 | Rainwater | 333/21 A |

FOREIGN PATENT DOCUMENTS

| | | | |
|---|---|---|---|
| 2266320 | 10/1975 | France | 333/21 A |

*Primary Examiner*—Eugene R. LaRoche
*Assistant Examiner*—Benny T. Lee
*Attorney, Agent, or Firm*—Kirschstein, Kirschstein, Ottinger & Israel

[57] ABSTRACT

A microwave polarizer is provided in the form of a wedge at the termination of a rod of dielectric material. Preferably the wedge tapers exponentially in order to provide a good impedance match. Circularly polarized radiation propagating along the rod experiences a differential phase shift at the wedge. This phase shift may be arranged to be 90°, so that linearly polarized radiation exits from the wedge. A continuous circular or square guide is used to contain the dielectric rod so that simultaneous orthogonal signals can be converted to or from circular polarizations. Such a wedge termination may be provided at the end of a splashplate or polyrod antenna feed, for a satellite communication system, where right-handed circular polarization is used on the up-link and left-handed circular polarization is used on the down link. The conventional orthomode transducer may be dispensed with, thereby enabling the sub-reflector to be located closer to the main reflector, thus reducing blockage and increasing the bandwidth.

7 Claims, 2 Drawing Sheets

DIELECTRIC ROD POLARIZER HAVING WEDGE SHAPE POLARIZING PORTIONS

This is a continuation of application Ser. No. 766,102, filed Aug. 15, 1985, now abandoned.

BACKGROUND OF THE INVENTION

1. Field of the Invention

The present invention relates to radio frequency polarisation, particularly microwave polarisation, and to communication systems utilising signals of a defined polarisation.

2. Description of Related Art

Satellite communications normally use circularly polarised signals. This is to economise on bandwidth by frequency re-use, where right-handed circular polarisation is used on the up-link and left-handed on the down-link. In addition, the source and receive antennas may be oriented by any angle with respect to each other without a significant loss of signal.

A polariser placed between the antenna feed and the rest of the system converts linearly (i.e., plane) polarised transmitted signals into right-handed circular polarisation, and converts received left-handed circular into the orthogonal linear polarisation. An orthomode transducer is then used to separate these two linear polarisations that, in normal operation, are simultaneously present in the waveguide behind the polariser.

Such communication systems may employ either a splashplate or a polyrod as an antenna feed. A splashplate comprises a rod of dielectric material which extends from a tubular metal waveguide (generally air-filled) and expands into a generally conical portion. The base of the conical portion is generally convex and is covered with a metal film, which film acts as a subreflector. A polyrod simply comprises a rod of dielectric material which extends from a tubular metal waveguide (generally air-filled) towards a conventional dish antenna. In either case the impedance of the dielectric rod has to be matched to that of the tubular metal waveguide, and this is achieved by conically tapering the dielectric rod (which is invariably of circular cross-section) to a point. The longer the tapered portion, the better the impedance matching. In practice, in view of the limited space available, the taper is made about two wavelengths long (corresponding to a length of 100 mm at X-band), which gives acceptable matching only over a bandwidth of around 15%.

In addition to the limitations imposed by the impedance-matching taper, the size of the system is increased and/or its performance is compromised by the characteristics of the polariser. A variety of microwave polarisers are known for use in tubular waveguide, and generally consist of sets of slots in the waveguide walls or bolts inserted through the slots in the waveguide walls or bolts inserted through the waveguide and oriented in an appropriate manner to differentially phase-shift the microwave radiation to achieve the required polarisation. One other type of microwave polariser, namely the vane polariser, consists of a thin sheet of dielectric material cut into two identical isosceles triangles, which triangles are joined at their apices to form a symmetrical coplanar "bow tie" which is located in an axial plane of the waveguide with the bases of the triangles perpendicular to the waveguide axis. A component of microwave radiation propagating axially in the plane of the "bow tie" experiences a greater mean dielectric constant than a component (which is essentially unaffected) propagating axially in a plane perpendicular to the "bow-tie" and accordingly undergoes a differential phase shift. The tapering edges of the triangles provide the required impedance matching, and the vane polariser necessarily has an appreciable length (typically two guide wavelengths).

One further example of a polariser is known from U.S. Pat. No. 3,216,017 in which a wedge formation is used to achieve polarisation. It is, however, essential to this prior art that the polariser be part of a waveguide transition from rectangular waveguide to circular waveguide. The rectangular guide limits the use of the polariser to conversion between a single linearly polarised wave and a circular or elliptical wave whereas the present invention is concerned with accommodating simultaneous orthogonal linearly polarised signals of the same frequency. Again, the rectangular/circular transition is essential to obtaining an impedance match in this prior art reference since the axial position of the dielectric wedge within the transition is adjustable in relation to the transition to obtain a match. The present invention is concerned with providing a polariser for both polyrod feeds and splashplate feeds and in the latter case axial movement of the dielectric and splashplate is not permissible since this would involve movement of the sub-reflector relative to the main reflector. Matching in the present invention is provided, as will be seen, by other means.

SUMMARY OF THE INVENTION

An object of the present invention is to provide a polariser which is suitable for use in a compact communication system of high bandwidth.

According to one aspect of the present invention, a radio frequency polariser comprises a rod of dielectric material, at least one end of which terminates in a wedge formation, the rod being contained in a tubular waveguide which is of constant cross sectional shape at least throughout the length of the wedge formation, the cross sectional shape being such as to permit propagation of orthogonal linearly polarised waves of the same frequency, the wedge formation being adapted to produce a differential phase-shift between orthogonal components of each of the orthogonal linearly polarised waves and consequent conversion between linear polarisation and elliptical or circular polarisation.

The wedge formation preferably comprises two surfaces converging towards a common plane, the two surfaces being of concave curvature in a longitudinal plane perpendicular to the common plane to provide an improved impedance match. The concave curvature is preferably of exponential form, the thickness of the wedge formation increasing exponentially from a thin edge in the common plane to the body of the dielectric rod.

The length of the wedge formation and the dielectric constant of the dielectric material may be such as to produce a differential phase-shift between, respectively, a plane-polarised wave component in the common plane and a plane-polarised wave component in the longitudinal plane perpendicular to the common plane, of 90°.

Opposite ends of the dielectric rod may terminate in a wedge formation, each wedge formation contributing part of the differential phase-shift between components' of a linearly polarised wave.

The tubular waveguide is preferably of circular section but may be square, the requirement being that orthogonal linearly polarised waves can be propagated simultaneously.

The length of the wedge formation is preferably between one and two wavelengths at the centre frequency of its bandwidth.

According to a second aspect of the invention, a microwave transmitter/receiver arrangement comprises a main reflector, a sub-reflector, a splashplate feed supplying circularly polarised signals to and receiving circularly polarised signals from the sub-reflector, and transmitter/receiver means adapted to supply linearly polarised signals to and receive lindearly polarised signals from the splashplate feed, the planes of polarisation of the linearly polarised signals being orthogonal and the splashplate feed incorporating a polariser as aforesaid.

The polariser of the invention is particularly suitable for polarising microwave radiation in the range 4 to 50 GHz.

The length, degree and form of taper of the wedge can be chosen to give a good impedance match whilst providing the required phase shifts in orthogonal planes to give the desired polarisation over a wide bandwidth. The performance achieved is potentially superior to that obtained from essentially two-dimensional polarisers such as the vane polariser of the prior art.

BRIEF DESCRIPTION OF THE DRAWINGS

A number of embodiments of the invention will now be described by way of example with reference to FIGS. 1 to 4 of the accompanying drawings, of which.

DETAILED DESCRIPTION OF THE PREFERRED EMBODIMENTS

Figure 1:
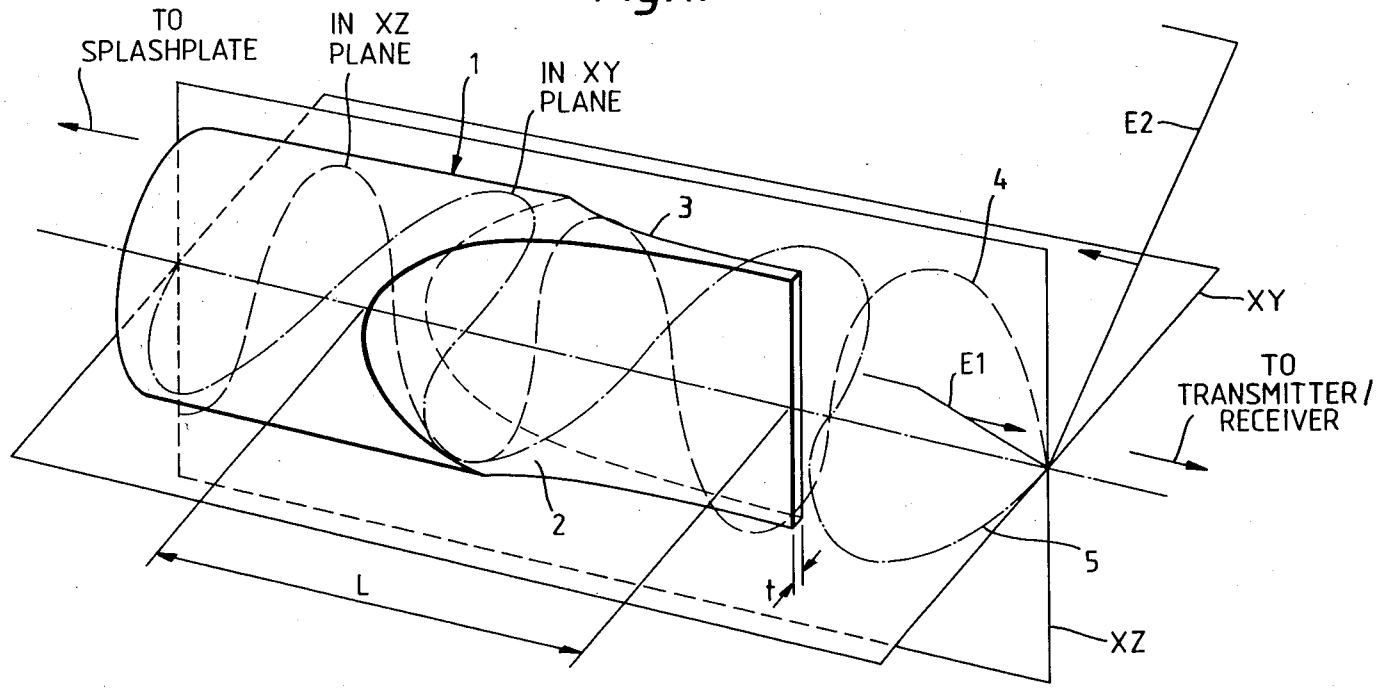
FIG. 1 is a sketch perspective view of a polariser in accordance with the invention.

Referring to FIG. 1, the microwave polariser shown comprises a polythene rod 1 of circular cross-section provided with two identical wedge surfaces 2 and 3 which are symmetrically disposed about the rod axis and converge towards the common, XZ, plane. The intersection of each of the wedge surfaces 2 and 3 with the XY plane is a concave exponential curve. The rod 1 is 27 mm in diameter and the length L of the wedge portion is 63 mm, which is approximately 1.5 wavelengths at the lowest operating frequency of 7.3 GHz. The thickness $t_{min}$ of the thin edge of the wedge is approximately 1 mm. The polythene rod 1 is fitted in an air-filled tubular metal waveguide (not shown in FIG. 1) and links a splashplate with a transmitter and a receiver.

The polarising effect of the wedge is illustrated by two orthogonal electric field waveforms 4 and 5 in the XZ and XY planes respectively. These plane polarised waveforms can be considered as the components of a left-hand circularly polarised signal received by the splash-plate and transmitted along rod 1 to its wedge termination at surfaces 2 and 3. While the waveforms are propagating in the circular portion of the rod 1, no phase shifts occur and the circular polarisation is maintained. When the waveforms reach the wedge portion (length L), there is an increase in wavelength, to an increasing extent with the horizontal (XY plane) component which is emerging into air, and to a much smaller extent with the vertical (XZ plane) component which remains largely in the polythene dielectric. Thus waveform 5, being perpendicular to the wedge surfaces 2 and 3, experiences a lower mean dielectric constant and undergoes a total phase change less than that of waveform 4. The length L is such that waveforms 4 and 5 emerge from the wedge in phase, corresponding to a linearly polarised wave, the plane of polarisation E1 being at 45° to the XY and XZ planes. Conversely, during transmission, a linearly polarised waveform (not shown) entering the wedge in the orthogonal plane E2 is converted to a right-hand circularly polarised waveform as it enters the circular portion of rod 1. Thus by employing an orthogonally polarised transmitter/-receiver combination, the same splashplate-fed antenna system can be used for both reception and transmission simultaneously. The signals transmitted from the antenna (which may form a communications link between a satellite and ground station for example), being circularly polarised, are received with maximum efficiency by the corresponding antenna at the other end of the link, irrespective of any relative rotation of the antennas.

Figure 2:
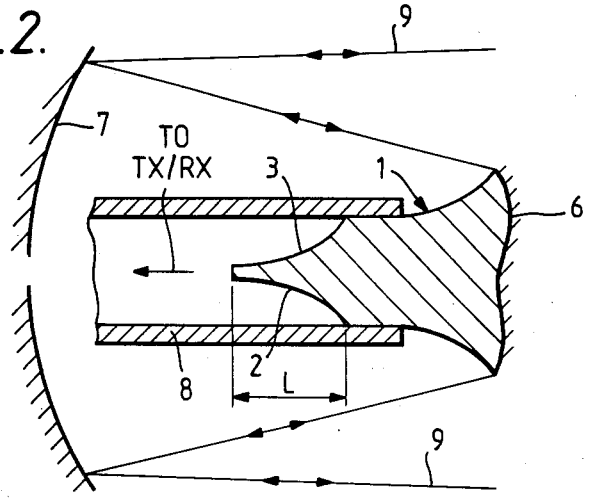
FIG. 2 is a diagrammatic cross section of a splashplate-fed antenna utilising the polariser of FIG. 1.

FIG. 2 shows the complete antenna system in which the rod 1 of the FIG. 1 is incorporated. Rod 1 is mounted in a tubular air-filled metal waveguide 8 which provides a microwave link to an orthogonally polarised transmitter/receiver combination. The protruding end of rod 1 expands into a splashplate on which a metal film sub-reflector 6 is formed. Sub-reflector 6 illuminates a main reflector 7 with microwave radiation to enable the latter to form a narrow beam 9 in transmission. The converse applies to reception. Since the length L of polythene rod 1 would need to be conically tapered in a conventional system provided with a separate polariser, the use of the polarising wedge (defined by surfaces 2 and 3) enables the length of waveguide 8 to be reduced, to make the system more compact. Furthermore the differential phase shift introduced by the wedge is substantially constant over a 25% bandwidth in the X-band, in comparison with a band-width of typically 15% or less for a typical two-dimensional polariser.

Figure 4:
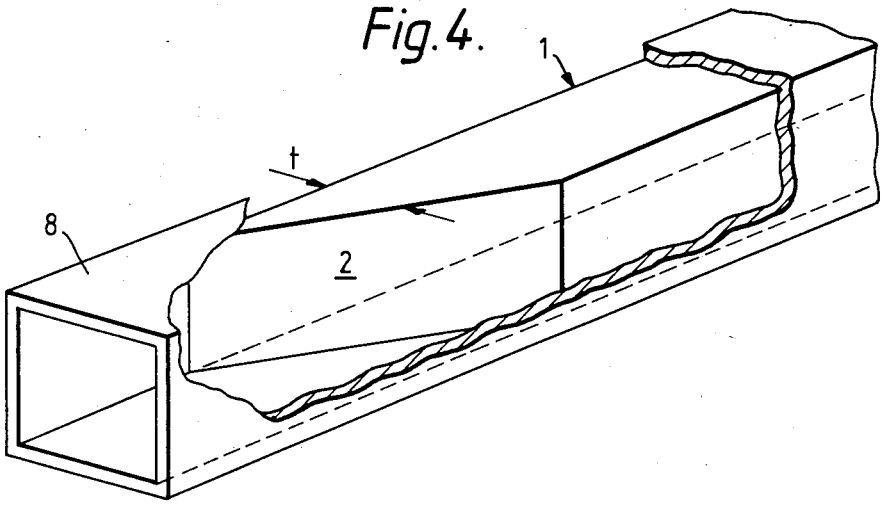

The design of a dielectric wedge can best be understood with reference to a linearly tapered wedge, for example as shown (asymmetric in this embodiment) in FIG. 4, where the rod 1 and the waveguide 8 are of square cross section, the rod 1 having a wedge surface 2. At any point along the wedge surface 2 an effective dielectric constant can be defined which takes on a different value depending upon whether the electric field vector is parallel or perpendicular to the plane of the wedge. Since the dielectric constant, E, defines the guide wavelength according to the formula:

$$\frac{1}{\lambda_g^2} = \frac{E}{\lambda_o^2} - \frac{1}{\lambda_c^2}$$

where $\lambda_g$ is the guide wavelength, $\lambda_o$ is the free space wavelength and $\lambda_c$ is the cut-off wavelength (which is constant for a particular waveguide size), the guide wavelength will vary along the wedge as the wedge thickness changes. A phase shift per unit length p(t) for a particular thickness of wedge, t, can be defined by the formula:

$$\rho(t) = \frac{2\pi}{\lambda_g(t)} \text{ radians}$$

where $\lambda_g(t)$ is the guide wavelength at wedge thickness t, $\lambda_g(t)$ being different for the parallel and perpendicular electric fields.

At a particular value of t the effective dielectric constants for parallel and perpendicular electric fields will yield guide wavelengths $\lambda_g'$ and $\lambda_g''$. The differential phase shift per unit length $P_d(t)$ is then:

$$\rho_d(t) = 2\pi\left(\frac{1}{\lambda'_g(t)} - \frac{1}{\lambda''_g(t)}\right)\text{radians}$$

and the total differential phase shift of the wedge is:

$$\int_o^L \rho_d(t)dx \text{ radians}$$

where L is the length of the wedge.

For the case of a linear wedge this integral becomes:

$$\frac{L}{D}\int_o^D \rho_d(t)dt$$

where D is the waveguide diameter.

Thus the total differential phase shift of the linear wedge is directly proportional to the length of the wedge. The length can then be chosen to yield a differential phase shift of 90°, which will generate pure circular polarisation provided the wedge is oriented at 45° to the linear electric field vector such that the parallel and perpendicular components are of equal amplitude.

The impedance match of a linear wedge is somewhat poor (though adequate for some applications) due to the fact that a smooth linear taper does not give a corresponding smooth change in impedance. Preferably therefore, the wedge is shaped to yield an exponential variation in impedance z(x) in accordance with the formula:

$$\frac{Z(x)}{Z_1} = \left(\frac{Z_2}{Z_1}\right)^{\frac{x}{L}}$$

where $Z_1$ is the impedance in air filled guide $Z_2$ is the impedance in dielectric filled guide x is the distance along the wedge.

The differential phase shift of the device is now given by:

$$\int_o^D \rho_d(t)F'(t)dt$$

where F'(t) is the derivative of the variation of wedge thickness with distance. The length of the wedge must now be an integral number of average half guide wavelengths at the frequency at which the exponential taper is calculated. This is usually the lowest frequency of operation. However the differential phase shift is then fixed by the length and shape of the wedge. Thus an iterative technique is required in which the frequency, at which the exponential is calculated, is varied until the final shape yields 90° differential phase shift. A very good match can thus be obtained without any adjustment of the axial position of the polariser, which can be chosen arbitrarily and is in fact chosen to give a minimum overall length to the feed.

Figure 3:
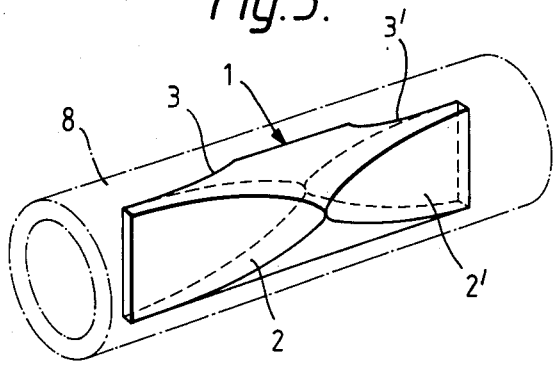
FIGS. 3 and 4 are sketch perspective views of further polarisers in accordance with the invention.

FIG. 3 shows a polariser for use in an air-filled tubular waveguide 8 in which no air-dielectric transition is required, but merely a change in polarisation. Accordingly a polythene rod 1 is provided with two sets of exponentially tapering wedge surfaces 2, 3 and 2', 3'. Thus two wedges are formed, which both provide an impedance match to the air filled waveguide. The maximum total differential phase shift is the sum of the differential phase shifts achieved by the two wedges. Thus for example if each wedge gives a differential phase shift of 90° then the polariser of FIG. 3 will rotate a linearly polarised waveform by up to 180°, depending on the orientation of the wedge with respect to the electric field.

We claim:

1. A radio frequency polarizer, comprising:

(a) a rod of dielectric material elongated along a length direction, (b) said rod having a body portion and at least one end portion, said body portion having a cross-section transverse to said length direction and said cross-section having a width direction transverse to said length direction, (c) said end portion having a length along said length direction and a wedge formation comprising a reduction of rod dimension in said width direction only, (d) a tubular waveguide elongated along a length direction and containing said rod therein, said length direction of said rod coinciding with said length direction of said tubular waveguide, (e) said tubular waveguide having a cross-section for carrying orthogonal plane-polarized waves, and said cross-section of said body portion conforming to and being a close fit in said cross-section of said tubular waveguide, (f) said cross-section of said tubular waveguide being constant throughout said length of said wedge formation, said wedge formation being non-critically positioned longitudinally along and within said tubular waveguide, and (g) said wedge formation of said rod of dielectric material effecting a differential phase-shift between orthogonal components of each of said orthogonal plane-polarized waves for conversion between plane and non-plane polarization.

2. A polarizer according to claim 1, wherein said wedge formation comprises two surfaces converging toward a common plane parallel to said length direction of said rod, said two surfaces being of concave curvature in a longitudinal plane perpendicular to said common plane for providing an improved impedance match.

3. A polarizer according to claim 2, wherein said rod comprises a body portion terminated by said wedge formation, said wedge formation comprising a thin edge in said common plane, said surfaces diverging from said thin edge toward said body portion, and wherein said curvature is of exponential form, the thickness of said wedge formation increasing exponentially from said thin edge to said body portion of said rod.

4. A polarizer according to claim 3, wherein said length of wedge formation in conjunction with a value of dielectric constant of said dielectric material produce said differential phase-shift of 90° between a plane-polarized wave component propagating in said common plane and a plane-polarized wave component propagating in said longitudinal plane.

5. A polarizer according to claim 1, wherein each opposite end of said rod terminates in said wedge formation, each wedge formation contributing part of said differential phase-shift between said components of each orthogonal plane-polarized wave.

6. A polarizer according to claim 1, wherein said tubular waveguide is of circular cross-section.

7. A polarizer according to claim 1, wherein said plane-polarized waves have operative frequencies, and wherein said length of said wedge formation is between one and two wavelengths at the operative frequencies of said plane-polarized waves.

* * * * *